United States Patent [19]

Kondoh

[11] Patent Number: 4,837,530

[45] Date of Patent: Jun. 6, 1989

[54] WIDEBAND (DC-50 GHZ) MMIC FET VARIABLE MATCHED ATTENUATOR

[75] Inventor: Hiroshi Kondoh, Santa Rosa, Calif.

[73] Assignee: Hewlett-Packard Company, Palo Alto, Calif.

[21] Appl. No.: 132,088

[22] Filed: Dec. 11, 1987

[51] Int. Cl.[4] ..... H01P 1/22

[52] U.S. Cl. ..... 333/81 A; 307/568; 333/262

[58] Field of Search ..... 333/103, 104, 81 R, 333/81 A, 262; 307/550, 568, 571

[56] References Cited

U.S. PATENT DOCUMENTS

| | | | |
|---|---|---|---|
| 3,921,106 | 11/1975 | Williams | 333/81 A X |
| 4,097,827 | 6/1978 | Williams | 333/81 A X |
| 4,523,161 | 6/1985 | Miles | 307/568 X |
| 4,733,203 | 3/1988 | Ayasli | 307/571 X |

OTHER PUBLICATIONS

Ayasli, *Microwave Switching With GaAs FETs*, Microwave Journal, Nov. 1982, pp. 61–74, TK-7800 M5 333–104.

*Primary Examiner*—Paul Gensler

*Attorney, Agent, or Firm*—William C. Milks, III

[57] ABSTRACT

A FET variable absorptive attenuator utilizes FETs as variable resistors controlled by voltages applied to their gate terminals, the FETs preferably being arranged in a T configuration with resistors connected in parallel with two series FETs, as well as a shunt FET in the form of a distributed shunt FET. One control voltage adjusts the resistances of the series FETs, and another controls the resistance of the distributed shunt FET. A proper combination of the two control voltages yields a desired level of attenuation with optimum input/output impedance matching. The resistors allow the series FETs to be biased well below their pinch-off voltages to minimize the parasitic capacitances of the series FETs at relatively high attenuation settings, improving the isolation for high attenuation settings at relatively high frequencies and also enabling the attenuator to function as a switch. They also improve the power-handling capability at high attenuation settings. The distributed shunt FET is split into several cells interconnected by inductive elements, providing a low insertion loss at maximum attenuation, as well as decreasing the parasitic capacitance of the shunt FET. The effects of this lower capacitance at relatively low attenuation settings can be more effectively counteracted by the inductive elements, extending the dynamic range of attenuation at relatively high frequencies. Also, the distributed shunt FET interconnected by the inductive elements compensates for the parasitic capacitances of the series FETs at relatively high attenuation settings, which yields increased attenuation with increasing frequency. Finally, the cutoff frequency of the attenuator at relatively low attenuation settings is increased.

21 Claims, 12 Drawing Sheets

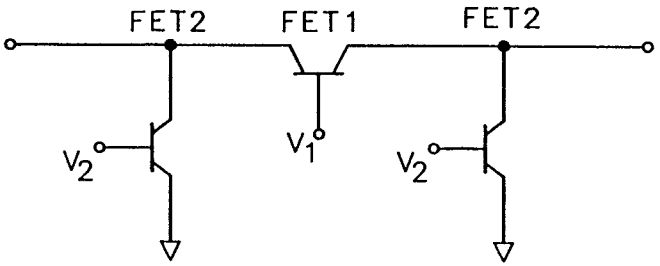
FIG 1B
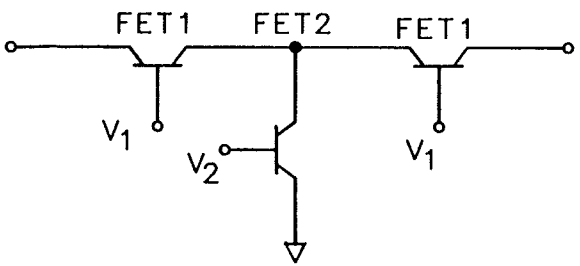
FIG 1A
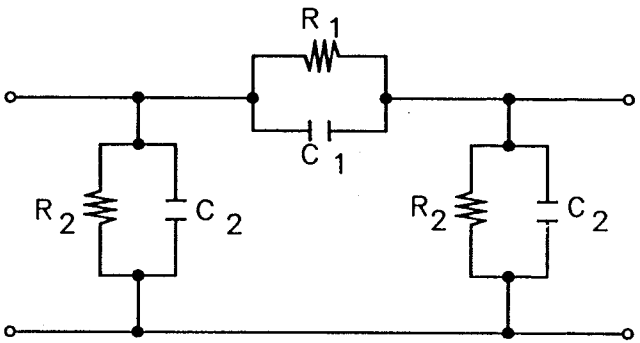
FIG 1D
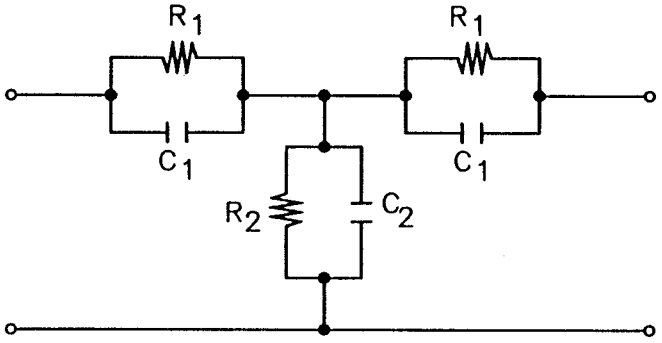
FIG 1C
FIG 1 (PRIOR ART)

WIDEBAND (DC-50 GHZ) MMIC FET VARIABLE MATCHED ATTENUATOR

BACKGROUND OF THE INVENTION

This invention relates to electronics and, more particularly, to variable attenuator circuits. Specifically, the invention is directed to a wideband microwave Field-Effect-Transistor (FET)-based variable attenuator, preferably fabricated as a microwave monolithic integrated circuit (MMIC), having an improved dynamic range of attenuation over a broad range of frequencies and also having optimal input/output impedance matching characteristics.

An attenuator is a device passing an input signal while operating to attenuate the signal by a precise amount. A variable attenuator allows the level of attenuation to be adjusted.

Gain control of amplifier cascades generally requires a variable attenuator circuit. Voltage-controlled variable attenuators have been widely used for automatic gain control circuits. In broadband microwave amplifiers, these attenuators are indispensable for temperature compensation of gain variation.

One type of voltage controlled variable attenuator is a FET variable absorptive attenuator which utilizes FETs as voltage-controlled resistors to adjust the attenuation. The basic mechanism of the circuit is the change in the low field resistance of a zero-biased FET controlled by gate voltage. An expression for the channel resistance of a FET in the linear region appears in Equation 3 of Barta, G. S., et al., "A 2 to 8 GHz Leveling Loop Using a GaAs MMIC Active Splitter and Attenuator," 1986 I.E.E.E. Microwave Circuits Symposium, pg. 75–79.

There are two known basic configurations of FET attenuators, T-type and Pi-type, the circuit schematics of which appear in FIG. 1. See Tajima, Y., et al., "GaAs Monolithic Wideband (2–28 GHz) Variable Attenuators," 1982 I.E.E.E. MTT-S Digest, pp. 479–481. Typically, three FETs are connected in T or Pi configuration, as shown in FIGS. 1A and 1B, respectively.

The electrical characteristics of each FET are expressed as a parallel combination of resistance and capacitance, as shown in the equivalent circuit schematics which appear in FIGS. 1C and 1D, where resistance is a varying value as a function of gate voltage. The value of resistance varies from the open-gate resistance to infinite resistance when the gate voltage is changed from the built-up voltage (positive) of the gate barrier to the pinch-off voltage (negative). On the other hand, capacitance is considered to be fairly constant with the gate voltage. The parasitic capacitance values are typically tenths of a picofarad.

At relatively low frequencies, when the effect of capacitance can be neglected, resistance(s) $R_1$, in a series arm, and resistance(s) $R_2$, in a shunt arm(s), must have a certain combination in order to both obtain a given attenuation and to meet the impedance matching conditions. In either the T or Pi configuration, a specified level of attenuation and optimum input/output matching are simultaneously achieved by a proper combination of resistances, $R_1$and $R_2$, controlled by voltages applied to the gate terminals of the FETs.

Insofar as dynamic range of attenuation is concerned, the minimum attenuation, or insertion loss, is determined primarily by the minimum achievable value for resistance $R_1$. For the same resistance $R_1$, Pi circuits have less insertion loss than T circuits.

In this regard, several factors must be considered when using FETs for the series and shunt elements. FET widths for the series FETs must be chosen wide enough for low insertion loss at minimum attenuation, but small enough to limit parallel drain-to-source capacitance, so that isolation at relatively high frequencies is sufficient. The isolation is most dependent on the parallel drain-to-source capacitance of the series FETs. For low insertion loss, the value of resistance $R_1$ can be reduced by increasing the gate width, but parasitic capacitance $C_1$will increase. Larger capacitance limits the dynamic range of attenuation at relatively high frequencies. In terms of the dynamic range, T circuits become advantageous over Pi circuits.

Considered in more detail, by employing series FETs with large gate widths, small gate lengths, and narrow source-drain spacings, the "ON" state insertion loss can be significantly reduced. Unfortunately, known FET attenuators typically exhibit high ON state insertion losses at relatively high frequencies. The effect of the drain-to-source parasitic capacitance of the series FETs upon the isolation increases markedly at these higher frequencies. Parasitic capacitances of the series FETs degrade the high-frequency performance, resulting in a larger minimum insertion loss and a more restricted maximum attenuation attainable as frequency increases. This severely limits the attenuation range at higher frequencies.

For example, Schindler, M. J., and Morris, A. M., "DC-40 GHz and 20–40 GHz MMIC SPDT Switches," 1987 I.E.E.E. Microwave and Millimeter-Wave Monolithic Circuits Symposium, pp. 85–88, particularly FIG. 2 on p. 86, discloses a single-pole-double-throw FET-based switch. The isolation provided by this switch continually decreases as frequency increases, as shown in FIG. 5 on page 87 of this article. This evidences that the parasitic capacitance dominates the operation of the circuit at relatively high frequencies, in spite of the incorporation of an artificial transmission line. Similarly, the attenuator manufactured by M/A-Com Advanced Semiconductor Operations of Lowell, Massachusetts incorporates inductive elements as disclosed in FIG. 2 of "DC to 20 GHz MMIC GaAs FET Matched Attenuator," Microwave Journal, March, 1986, p. 195. However, the dynamic range of attenuation at 20 GHz is half that at 2 GHz, as shown in FIG. 3 of this article. This demonstrates that the parasitic capacitance degrades the performance of the attenuator at relatively high frequencies, notwithstanding the inductive elements fabricated in the circuit. Therefore, it is desirable to provide an attenuator in which the effects of parasitic capacitance are reduced so that the dynamic range of attenuation at relatively high frequencies can be extended.

Insofar as input/output impedance matching is concerned, for amplifier stability, it is desirable that the attenuator provides constant source and load match irrespective of the attenuation value. The aforementioned Barta, et al., article discloses that feedback can be used to control input and output return loss as attenuation is changed, invariant of any process effects or differences between FET geometries. FIG. 2 of this article shows a reference attenuator cell where an operational amplifier adjusts the shunt FET gate voltage in response to an arbitrary voltage variation on the series FET gate, maintaining a 50-ohm environment. Unfortunately, this solution of the impedance matching problem, particularly near minimum and maximum attenuation, requires an additional circuit having a complexity which exceeds that of the attenuator.

Also, the use of FETs as switching elements is well documented. See McLevige, W.V., and Sokolov, V., "Microwave Switching With Parallel-Resonated GaAs FETS,"I.E.E.E. Electron Device Letters, Vol. EDL-1, No. 8, August, 1980, pp. 156–158. By connecting the source and drain of a FET in series with a transmission line, the gate can be used to pinch off the channel and switch the device to the "OFF" state. When the gate is biased at zero volts (the "ON" state), a small resistance is present between the source and drain. When the gate is biased beyond pinch-off (the OFF state), the source and drain are capacitively coupled. Resistive elements are also present. Isolation can be improved by parallel resonating the source-drain capacitance with an inductor. However, this is effective only over a narrow frequency band. In order to minimize the effect of the OFF state capacitance in a broadband switch, a shunt FET is inserted. When the switch is closed, the shunt FET is pinched-off and acts primarily as a shunt capacitance. When the switch is open, the series FETs are pinched-off and act primarily as small capacitances. This capacitance is essentially grounded through the shunt FET. Isolation is primarily provided by the shunt FET, particularly at relatively high frequencies, where the series FETs provide very little isolation. Unfortunately, this FET-based switch does not provide sufficient isolation at maximum attenuation over a broad band of frequencies.

SUMMARY OF THE INVENTION

One embodiment of the attenuator in accordance with the present invention overcomes these problems by employing two novel circuit improvements in a FET variable absorptive attenuator. The attenuator utilizes FETs as variable resistors controlled by voltages applied to their gate terminals. The FETs preferably are arranged in a T configuration with resistors connected in parallel with two series FETs and a shunt FET in the form of a distributed shunt FET. One control voltage adjusts the resistances of the series FETs, and another controls the resistance of the distributed shunt FET. A proper combination of the two control voltages yields a desired level of attenuation with optimum input/output impedance matching.

The attenuator in accordance with the invention incorporates resistors having a predetermined resistance, for example, approximately 50 ohms, connected in parallel with the series FETs. These resistors allow the series FETs to be biased well below their pinch-off voltages to minimize the parasitic capacitances at relatively high attenuation settings. The incorporation of resistors in parallel with the series FETs improves the isolation for high attenuation settings at relatively high frequencies. This also enables the attenuator to function as a single-pole-single-throw switch. The resistors also improve the power-handling capability of the attenuator at high attenuation settings.

Also, the incorporation of resistors in parallel with the series FETs obviates the need to proliferate the number of gate fingers so as to increase the gate width in order to reduce insertion loss, which heretofore undesirably increased the drain-to-source capacitance caused by the interconnection parasitics which occur in interdigitated structures resulting in constricted bandwidth and limited dynamic range of attenuation. Also, the incorporation of resistors having a predetermined resistance, for example, 50 ohms, in parallel with the series FETs supplants the need for a complex analog biasing circuit which operates to maintain a desired impedance match at maximum attenuation.

The attenuator in accordance with the invention also incorporates a distributed shunt FET. The shunt FET is split into several cells which are interconnected by transmission lines or equivalent inductances. The incorporation of a distributed shunt FET interconnected by transmission lines or equivalent inductances extends the dynamic range of the attenuator to selectively higher frequencies.

Heretofore, by employing shunt FETs with large gate widths, small gate lengths, and narrow source-drain spacings, the ON state insertion loss was significantly reduced, but only at the expense of increasing the parasitic capacitance. This increased the insertion loss of the attenuator at minimum attenuation and limited the dynamic range of attenuation at relatively high frequencies. The incorporation of a distributed shunt FET provides a low insertion loss at maximum attenuation, as well as decreases the parasitic capacitance of discrete cells of the shunt FET. The effects of this lower capacitance at relatively low attenuation settings can be more effectively counteracted by the transmission lines or equivalent inductances. This extends the dynamic range of attenuation at relatively high frequencies. Also, the circuit of the distributed shunt FETs interconnected by the transmission lines or equivalent inductances compensates for the parasitic capacitances of the series FETs at relatively high attenuation settings. This yields increased attenuation with increasing frequency. Finally, since the cutoff frequency is proportional to $\frac{1}{2}Pi(LC)^{\frac{1}{2}}$, and both the inductance and capacitance of the attenuator are decreased by the incorporation of the distributed shunt FET, the cutoff frequency of the attenuator at relatively low attenuation settings is also higher.

BRIEF DESCRIPTION OF THE DRAWINGS

The above and other features of the invention and the concomitant advantages will be better understood and appreciated by persons skilled in the art in view of the detailed description given below in conjunction with the accompanying drawings. In the drawings:

FIG. 1, comprising FIGS. 1A–1D, shows known FET attenuators and their equivalent circuits, FIG. 1A showing a T configuration with its equivalent circuit being shown in FIG. 1C, and FIG. 1B showing a Pi configuration with its equivalent circuit being shown in FIG. 1D;

FIG. 4, comprising

DETAILED DESCRIPTION OF THE PREFERRED EMBODIMENTS

Figure 2A:
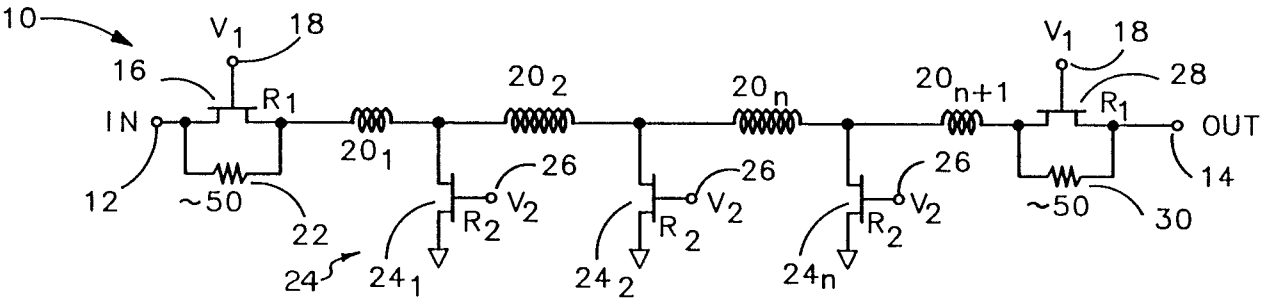
FIG. 2A shows a schematic circuit diagram of the attenuator in accordance with one embodiment of the invention, the equivalent circuit at maximum attenuation being shown in FIG. 2B and the equivalent circuit at minimum attenuation being shown in FIG. 2C.
Figure 2C:
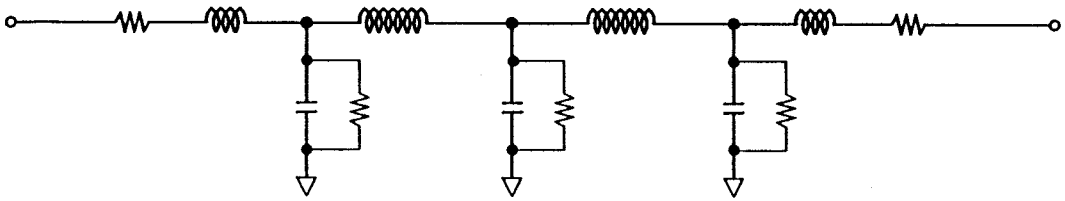

A schematic circuit of one embodiment of the attenuator in accordance with the present invention is shown in FIG. 2A. The attenuator, generally indicated by the numeral 10, preferably comprises a T-type FET variable absorptive attenuator connected between an input 12 and an output 14.

The attenuator 10 comprises a first series FET 16 having its drain connected to the input 12, its gate connected to a first voltage supply 18, which supplies a gating voltage $V_1$, and its source connected to an inductive reactance $\mathbf{20}_1$. The inductive reactance $\mathbf{20}_1$ comprises a transmission line segment or equivalent inductance.

Additionally, the attenuator 10 comprises a first resistor 22 connected between the drain and source of the first series FET 16. The resistor 22 has a predetermined value of resistance, for example, approximately 50 ohms, depending on the output impedance of the circuit connected to the input 12.

The attenuator 10 also comprises a distributed shunt FET 24. The shunt FET 24 is split into several cells $\mathbf{24}_1$, $\mathbf{24}_2$, . . . , $\mathbf{24}_n$. Each cell $\mathbf{24}_1$, $\mathbf{24}_2$, . . . , $\mathbf{24}_n$ has its drain connected between respective inductive reactances $\mathbf{20}_1$ and $\mathbf{20}_2$, $\mathbf{20}_2$ and $\mathbf{20}_n$, $\mathbf{20}_n$ and $\mathbf{20}_{n+1}$ in the form of transmission lines or equivalent inductances. The gate of each cell $\mathbf{24}_1$, $\mathbf{24}_2$, . . . , $\mathbf{24}_n$ is connected to a second voltage supply 26, which supplies a gating voltage $V_2$, and the source of each cell is connected to common.

Furthermore, the attenuator 10 comprises a second series FET 28 having its source connected to the inductive reactance $\mathbf{20}_{n+1}$, its gate connected to the first voltage supply 18, which supplies the gating voltage $V_1$, and its drain connected to the output 14.

Finally, the attenuator 10 comprises a second resistor 30 connected between the drain and source of the second series FET 28. The resistor 30 has a predetermined value of resistance, for example, approximately 50 ohms, depending on the input impedance of the circuit connected to the output 14.

Figure 4A:
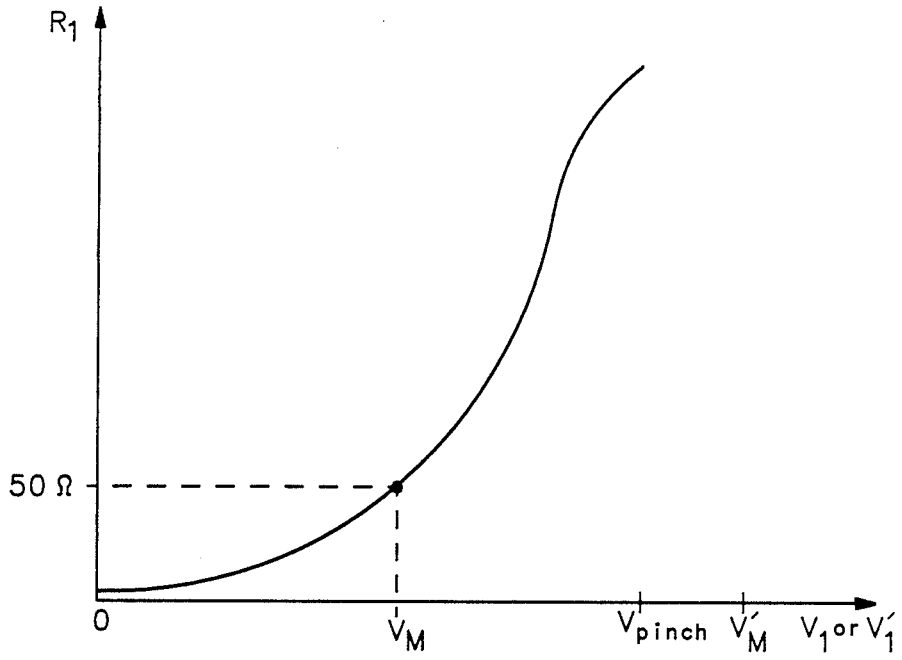
FIGS. 4A and 4B, shows values of resistance (FIG. 4A) and capacitance (FIG. 4B) as a function of voltage applied to the gate of the series FETs shown in FIG. 2.
Figure 4B:
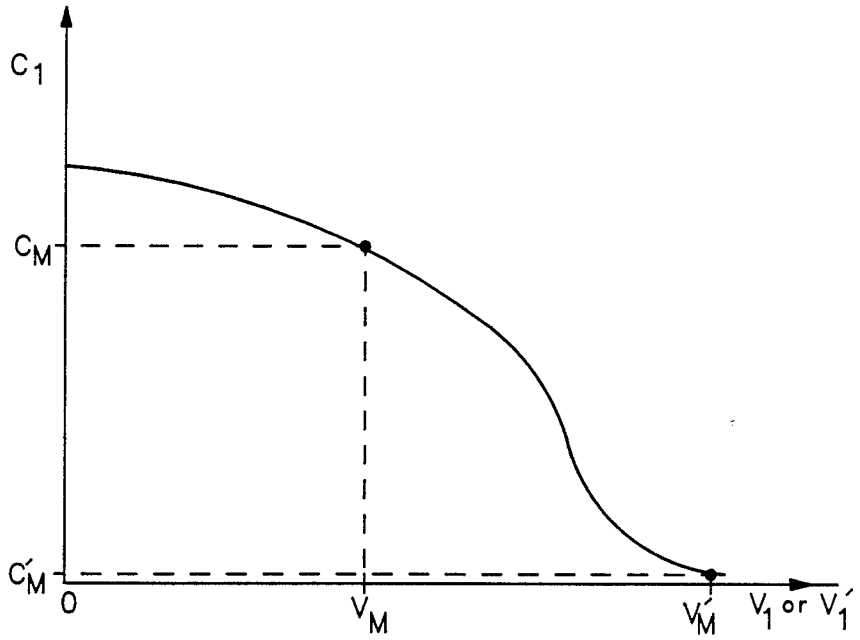

By way of explanation, the effective resistance and capacitance of a series FET are denoted $R_1$ and $C_1$, respectively, as shown in FIG. 1. At maximum attenuation, in order to maintain optimum input/output impedance matching, resistance $R_1$ is approximately a predetermined impedance, for example, 50 ohms, which requires the control voltage $V_1$ to be $V_M$, as shown in FIG. 4A. For a given size of FET, this voltage level $V_M$ uniquely determines an associated parasitic capacitance $C_1$ to be $C_M$, as shown in FIG. 4B.

Figure 2B:
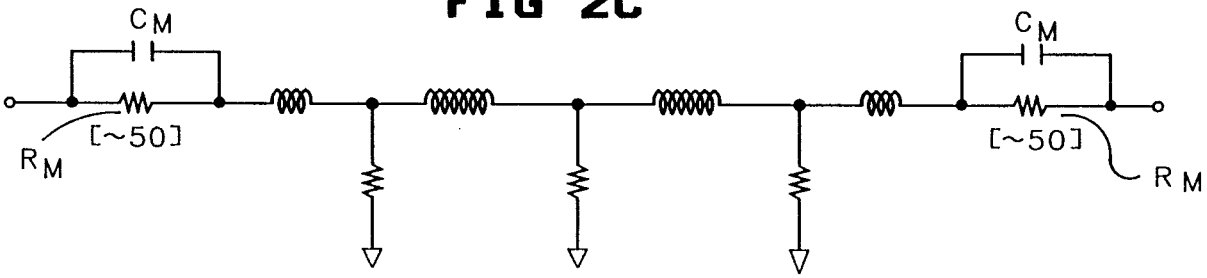

FIG. 2B shows an equivalent schematic circuit of the attenuator 10 having approximately 50-ohm resistors 22 and 30 connected in parallel with the respective series FETs 16 and 28. Despite the addition of the resistors 22 and 30, the equivalent circuit is similar to the equivalent circuit shown in FIG. 1C. At maximum attenuation, however, series FET resistance should be and is allowed to be infinite, which requires a control voltage $V_1'$ to be $V_M'$ below the pinch-off voltage, as shown in FIG. 4A. The corresponding parasitic capacitance is now $C_M'$, which is much smaller than $C_M$, as shown in FIG. 4B. This reduced capacitance of each series FET significantly improves high frequency performance of the attenuator 10, while maintaining optimum input/output matching.

The resistors 22 and 30 allow the series FETs 16 and 28 to be biased well below their pinch-off voltages to minimize the parasitic capacitances at relatively high attenuation settings. The resistors 22 and 30 also improve the power-handling capability of the attenuator 10 at relatively high attenuation settings.

The incorporation of the distributed shunt FET 24 interconnected by the inductive reactances $\mathbf{20}_1$, $\mathbf{20}_2$, . . . , $\mathbf{20}_n$, $\mathbf{20}_{n+1}$ extends the dynamic range of the attenuator 10 to selectively higher frequencies. The size of each cell $\mathbf{24}_1$, $\mathbf{24}_2$, . . . , $\mathbf{24}_n$, i.e., the distributed shunt FET gate periphery, is selected such that, at minimum attenuation, the parasitic capacitance of the distributed shunt FET 24 can be effectively neutralized by the inductive reactances $\mathbf{20}_1$, $\mathbf{20}_2$, . . . , $\mathbf{20}_n$, $\mathbf{20}_{n+1}$ which interconnect them. The combination of the series inductance of the inductive reactances $\mathbf{20}_1$, $\mathbf{20}_2$, . . . , $\mathbf{20}_n$, $\mathbf{20}_{n+1}$ and the shunt capacitance of the cells $\mathbf{24}_1$, $\mathbf{24}_2$, . . . , $\mathbf{24}_n$ forms an artificial transmission line. Consequently, the parasitic capacitance of the distributed shunt FET 24 can be absorbed into an LC ladder circuit to form a 50-ohm artificial transmission line. Division of the total gate periphery among the cells $\mathbf{24}_1$, $\mathbf{24}_2$, . . . , $\mathbf{24}_n$ reduces the equivalent parasitic capacitance and enables the required inductance to be provided by deposited thin-film metal lines. Since both the capacitance and inductance of the attenuator 10 are reduced, the maximum frequency of operation is extended.

Also, the resistance of the distributed shunt FET 24 is not lowered at the expense of raising the parasitic capacitance of the shunt FET, which would tend to increase the minimum insertion loss at minimum attenuation. Furthermore, division of the gate periphery among the cells $\mathbf{24}_1$, $\mathbf{24}_2$, . . . , $\mathbf{24}_n$ reduces the equivalent shunt resistance at relatively high attenuation settings. At relatively high attenuation settings, the tendency for the rise in attenuation to fall off as the frequency increases, due to residual capacitances of the series FETs 16 and 28, is compensated for by parallel LR circuits connected across the respective series FETs (FIGS. 3 and 5) and an LR circuit of the distributed shunt FET 24 interconnected by the inductive reactance $\mathbf{20}_1$, $\mathbf{20}_2$, . . . , $\mathbf{20}_n$, $\mathbf{20}_{n+1}$. This yields increased attenuation with increasing frequency.

The narrower gate width for the individual cells $\mathbf{24}_1$, $\mathbf{24}_2$, . . . , $\mathbf{24}_n$ assists in minimizing the insertion loss of the attenuator 10. A high OFF resistance of the distributed shunt FET 24 is needed to obtain optimum insertion loss. The number of cells $\mathbf{24}_1$, $\mathbf{24}_2$, . . . , $\mathbf{24}_n$ is preselected as follows, based on the operating frequency range desired.

The greater the number of cells $\mathbf{24}_1$, $\mathbf{24}_2$, . . . , $\mathbf{24}_n$, the less the equivalent OFF resistance. Accordingly, the number of cells $\mathbf{24}_1$, $\mathbf{24}_2$, . . . , $\mathbf{24}_n$ is not so many that the shunt resistance is comparable with the impedance of the load. The number of cells $\mathbf{24}_1$, $\mathbf{24}_2$, . . . , $\mathbf{24}_n$ is given by the following equation:

$$(Pi)(f_c)\sqrt{\frac{(32)(50)(C_{50})}{\left(\frac{G_{F0}}{C_{F0}}\right)\left(\frac{C_{F0}}{C_{FP}}\right)}} \leqq N << \frac{1}{50\ G_{FP}}$$

where N is the number of shunt FET cells;

$f_c$ is the cutoff frequency;

$C_{50}$ is the capacitance of a series FET for its resistance value of 50 ohms;

$G_{FO}$ is the conductance of a shunt FET cell biased at zero volts at its gate;

$C_{FO}$ is the capacitance of a shunt FET cell biased at zero volts at its gate;

$C_{FP}$ is the capacitance of a shunt FET cell biased below its pinch-off voltage; and $G_{FP}$ is the conductance of a shunt FET cell biased below its pinch-off voltage.

Figure 3:
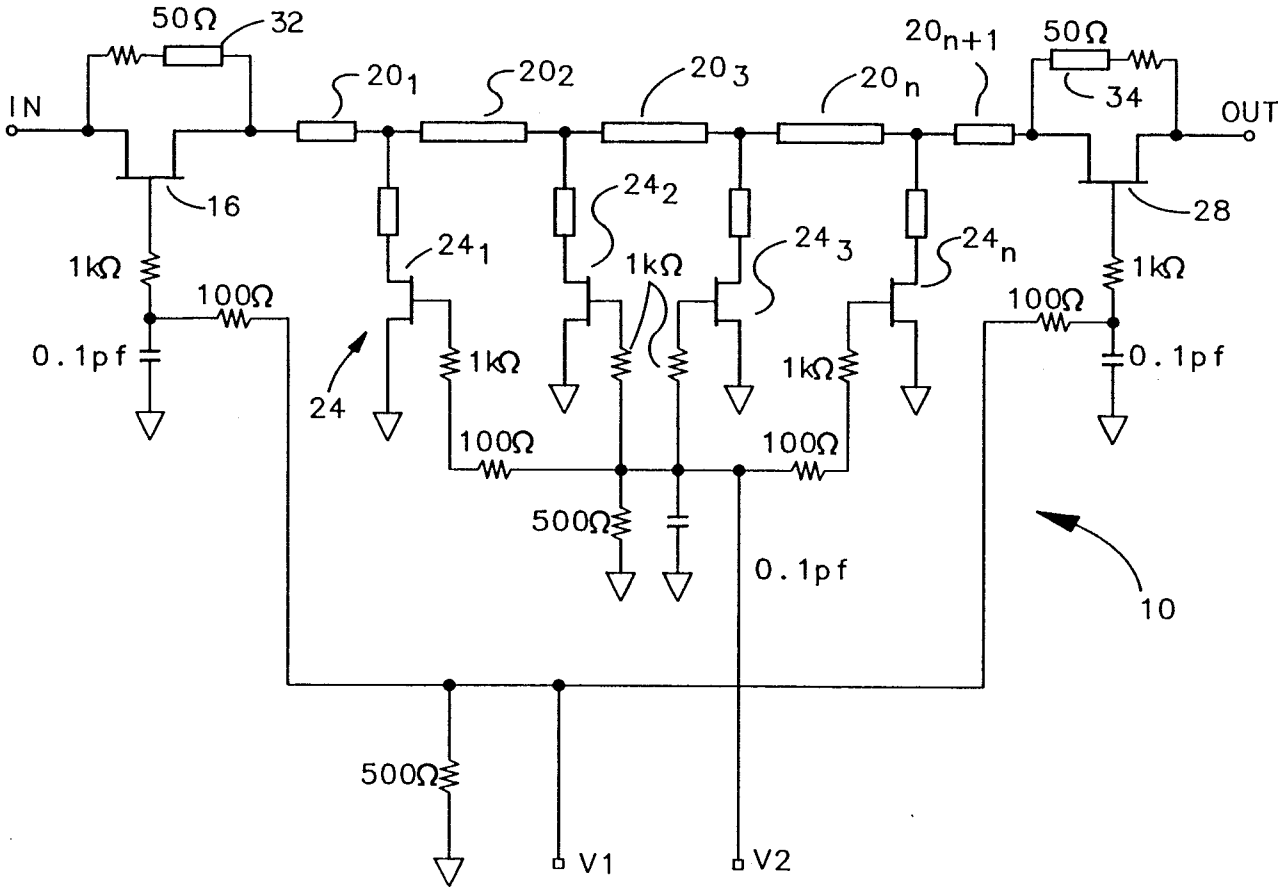
FIG. 3 is a detailed schematic circuit diagram of the attenuator shown in FIG. 2A.
Figure 5:
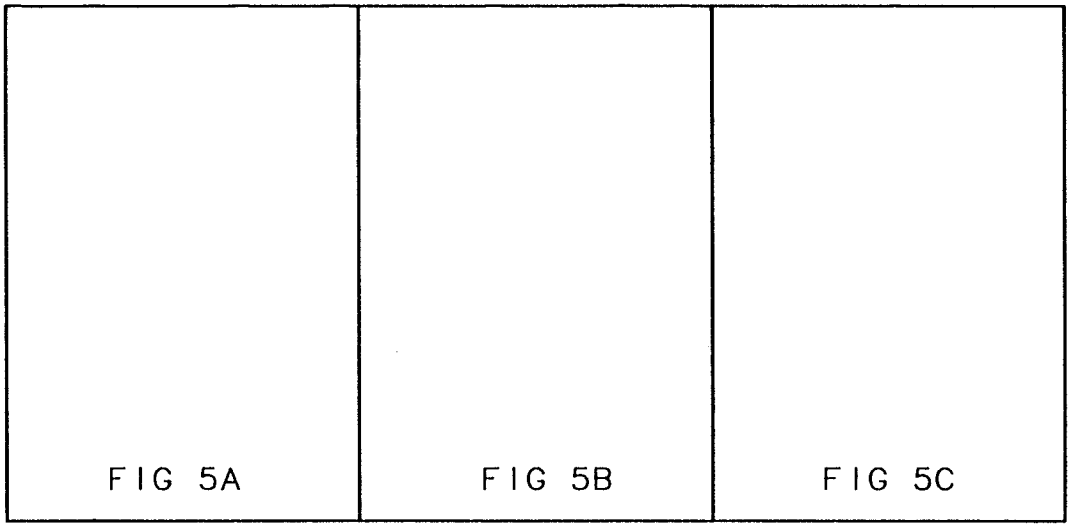
FIG. 5 illustrates a chip layout for the attenuator shown in FIG. 3.
Figure 5A:
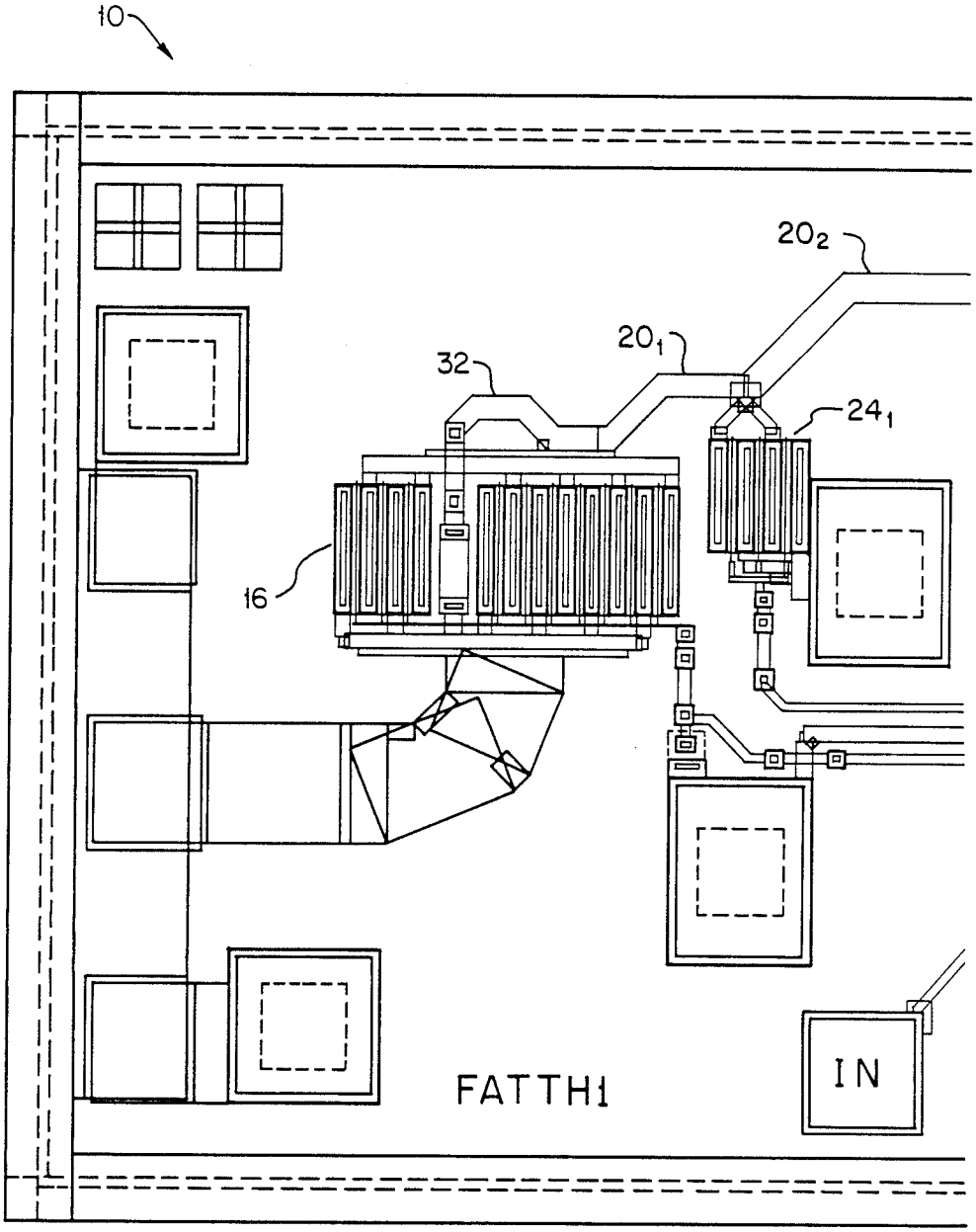
Figure 5B:
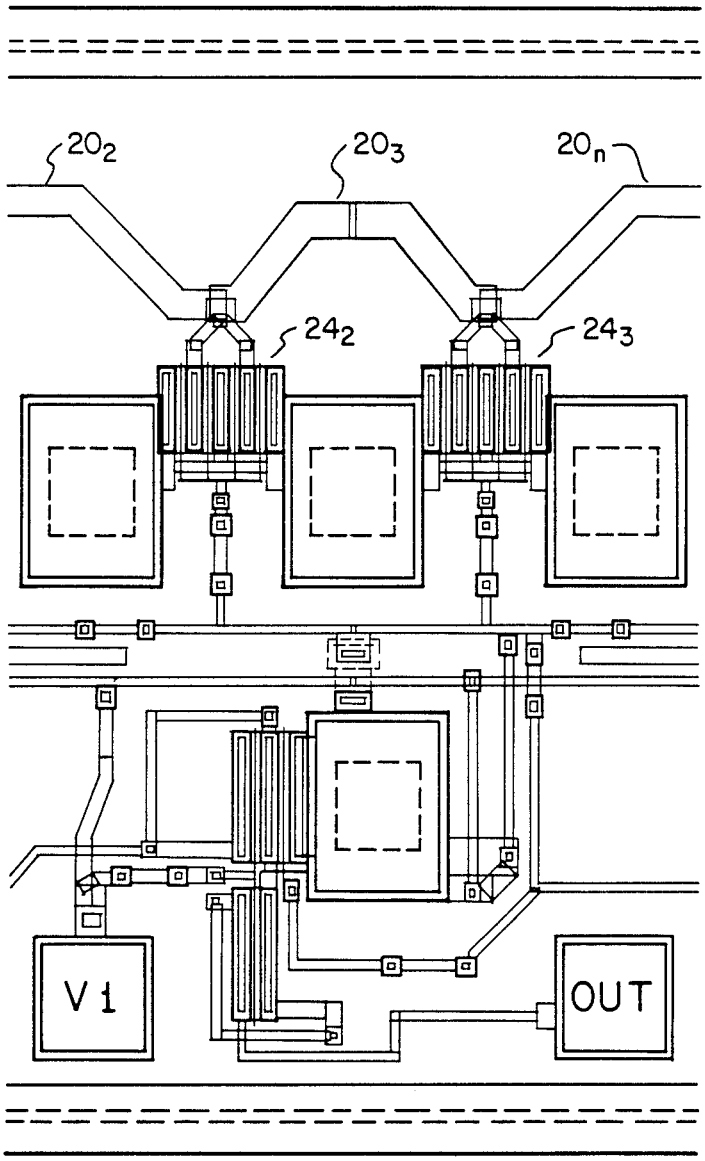
Figure 5C:
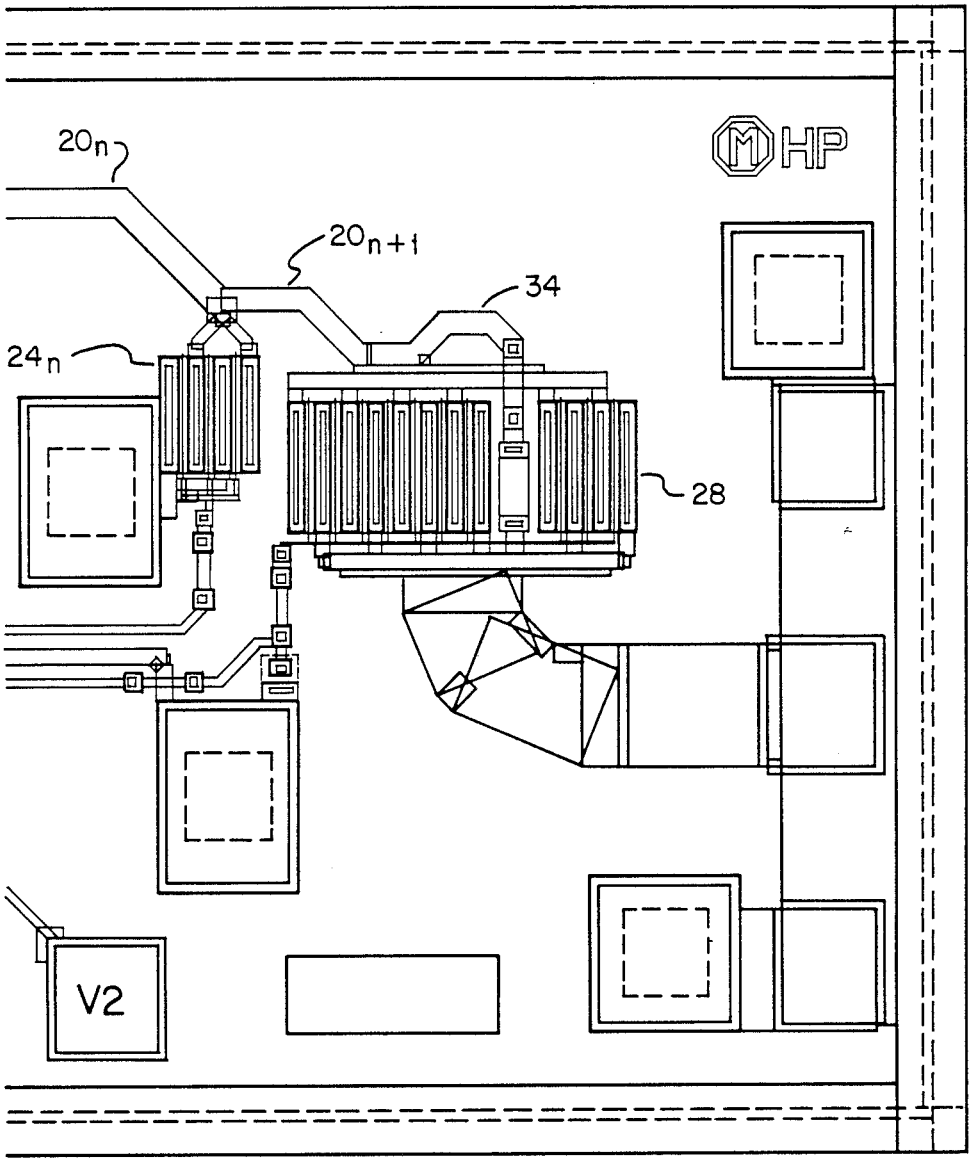

The circuit improvements described above have been implemented in an attenuator 10 in the form of a gallium arsenide (GaAs) monolithic integrated circuit, as shown in FIGS. 3 and 5. Each series FET 16 and 28 preferably has a 750 μm gate width, a 4.5 μm source-drain spacing, and a 0.5 μm gate length (defined by electron-beam lithography). Each cell $\mathbf{24}_1, \mathbf{24}_2, \ldots, \mathbf{24}_n$ preferably has a 200 μm gate width, a 4.5 μm source-drain spacing, and a 0.5 μm gate length (defined by electron-beam lithography). The material for the FETs is preferably molecular beam epitaxy GaAs doped to $3\times10^{17}$ cm$^{-3}$ on a 100 μm GaAs substrate.

The inductive reactances $\mathbf{20}_1, \mathbf{20}_2, \ldots, \mathbf{20}_n, \mathbf{20}_{n+1}$ are preferably in the form of transmission lines realized with plated gold. Thin-film metal depositions 13 μm in width and having a length of 120 μm are preferably employed as the resonant inductors 32 and 34 in parallel with the source-drain capacitance of the series FETs 16 and 28, respectively. Thin-film meander lines form the inductors of the artificial transmission line. The inductance of each line is on the order of 0.05 nh. Input and output microstriplines are connected to drain contacts of the series FETs 16 and 28, while source contacts are connected by a metal strip which serves as a connection to the drain contacts of the cells $\mathbf{24}_1, \mathbf{24}_2, \ldots, \mathbf{24}_n$. The source contacts of the cells $\mathbf{24}_1, \mathbf{24}_2, \ldots, \mathbf{24}_n$ are grounded by a via hole. As shown in FIGS. 3 and 5, isolation between the RF circuit and DC control circuit is achieved by thin-film and N-layer bulk resistors. These elements are inserted between gate terminals and bias terminals in order to reduce the leakage of RF signals to DC terminals. Gate bias is provided through N-layer bulk resistors. The chip dimensions are $1.52\times0.65$ mm$^2$ ($60\times26$ mils$^2$).

In operation, at relatively low attenuation settings, the series FETs 16 and 28 are biased in the ON state and act as small series resistances, allowing the input signal to pass (with some low level of attenuation). The series FETs 16 and 28 approximate a short circuit. The distributed shunt FET 24 is pinched-off and acts primarily as a shunt capacitance. However, the cells $\mathbf{24}_1, \mathbf{24}_2, \ldots, \mathbf{24}_n$ are connected through the series inductive reactances $\mathbf{20}_1, \mathbf{20}_2, \ldots, \mathbf{20}_n, \mathbf{20}_{n+1}$. The combination of the series inductance and the shunt capacitance of the distributed shunt FET 24 forms an artificial transmission line. Consequently, the parasitic capacitance of the distributed shunt FET 24 is absorbed into an LC ladder circuit to form a 50-ohm artificial transmission line.

Additionally, at relatively high attenuation settings, the input/output impedance of the attenuator 10 is 50 ohms. At relatively high attenuation settings, the series FETs 16 and 28 are pinched-off. The distributed shunt FET 24 is biased in the ON state and acts as a small shunt resistance, allowing the input signal to pass (with some high level of attenuation). The tendency for the rise in attenuation to fall off as the frequency increases, due to residual capacitance of the series FETs 16 and 28, is compensated for by an LR circuit of the distributed shunt FET 24, which yields increased attenuation with increasing frequency. Radiative losses at relatively high frequencies are negligible.

The series FETs 16 and 28 are gated with one control voltage $V_1$, while the distributed shunt FET 24 is gated by another control voltage $V_2$, in order to provide a given attenuation. Unfortunately, these two gating voltages do not change linearly with respect to RF attenuation in dB.

Preferably, however, a single voltage source is provided to supply these control voltages and to establish a linear relationship between RF attenuation in dB and this control voltage. An example of such a control circuit appears in FIG. 5 of the aforementioned article by Tajima, et al. This circuit comprises a noninverting linear amplifier and an inverting non-linear amplifier employing dual operational amplifiers, diodes and resistors. A potentiometer provides a linear relationship with RF attenuation. Since no DC bias voltages are applied to the drains of the FETs, the attenuator 10 dissipates no DC power.

Figure 6:
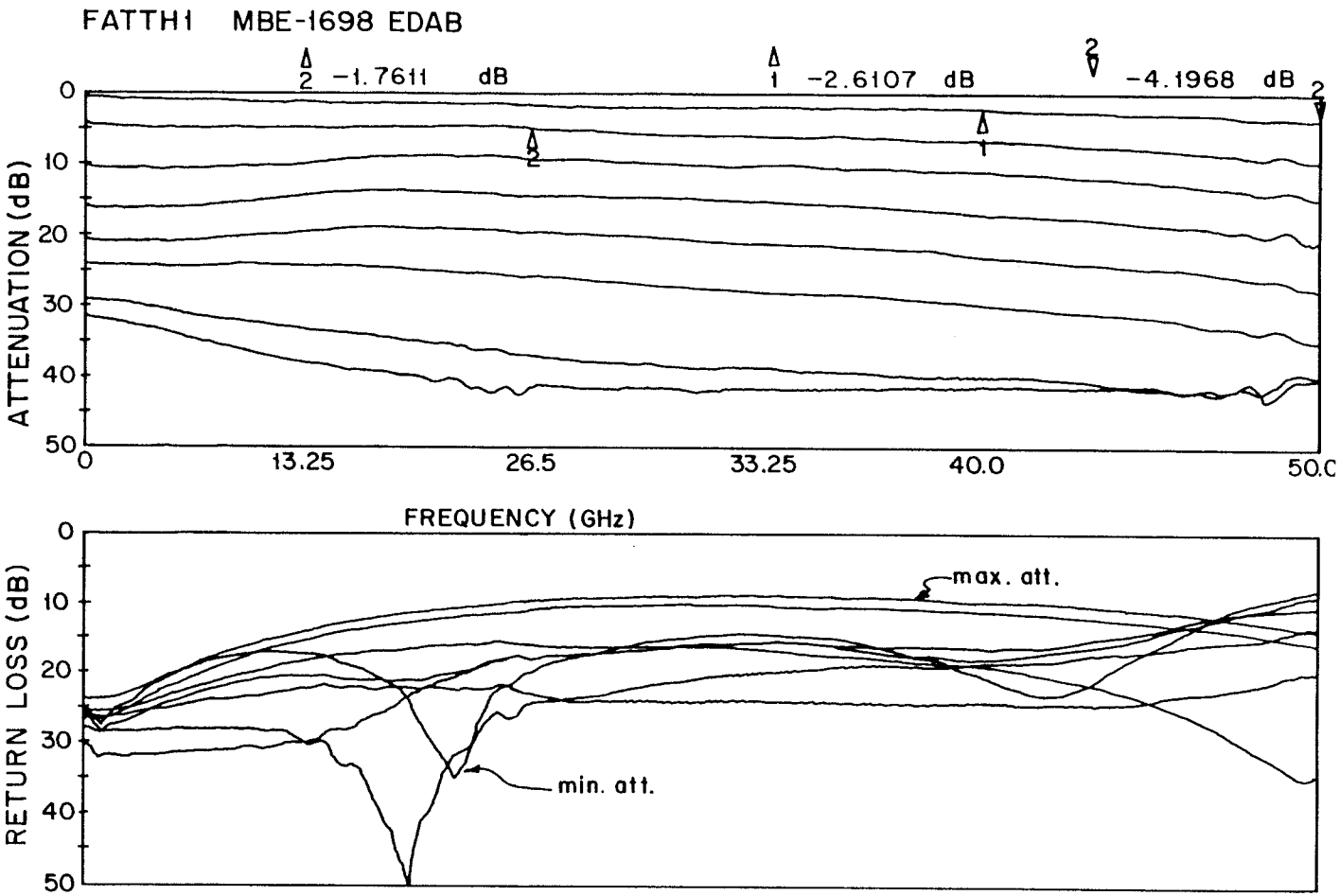
FIG. 6 illustrates the performance of the attenuator shown in FIG. 3 from DC to 50 GHz.
Figure 7:
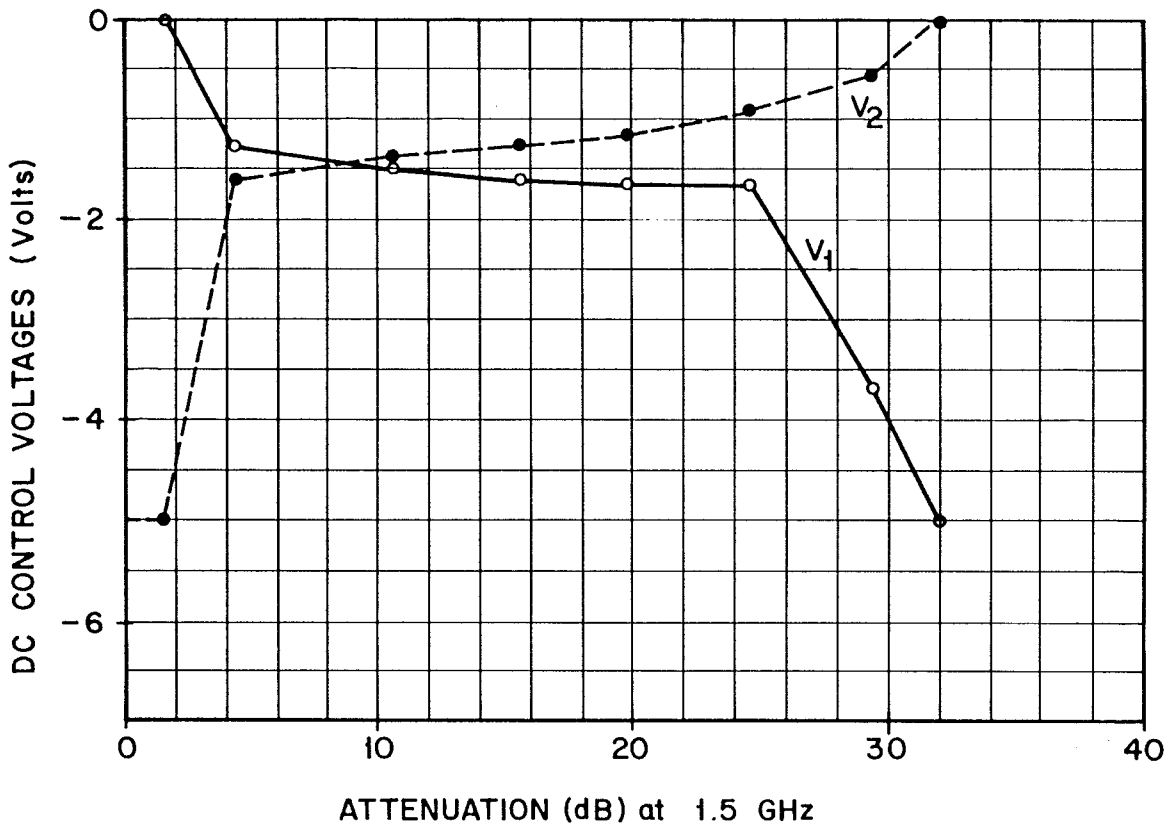
FIG. 7 is a graph of the two control voltages used in obtaining the measurements shown in FIG. 6.

FIG. 6 shows the attenuation characteristics of the attenuator 10 in accordance with the invention measured at frequencies between DC and 50 GHz in response to the control voltages $V_1$ and $V_2$ shown in FIG. 7. The attenuator 10 demonstrates a minimum insertion loss of 0.6 dB at 300 KHz, 1.8 dB at 26.5 GHz, and 2.6 dB at 40 GHz, as shown in FIG. 6, and a greater than 32 dB maximum attenuation across the band 32 dB at 300 KHz and 42 dB at 26.5 and 40 GHz). The input/output return loss is measured to be at least 10 dB at any attenuation setting from DC to 40 GHz. The attenuator 10 exhibits low DC power consumption, i.e., very little power dissipation, since no drain bias is employed. As compared to known FET attenuators, the attenuator 10 in accordance with the invention shows a greater bandwidth and increased attenuation with increasing frequency at relatively high attenuation settings exhibited a broader dynamic range of attenuation.

Figure 8:
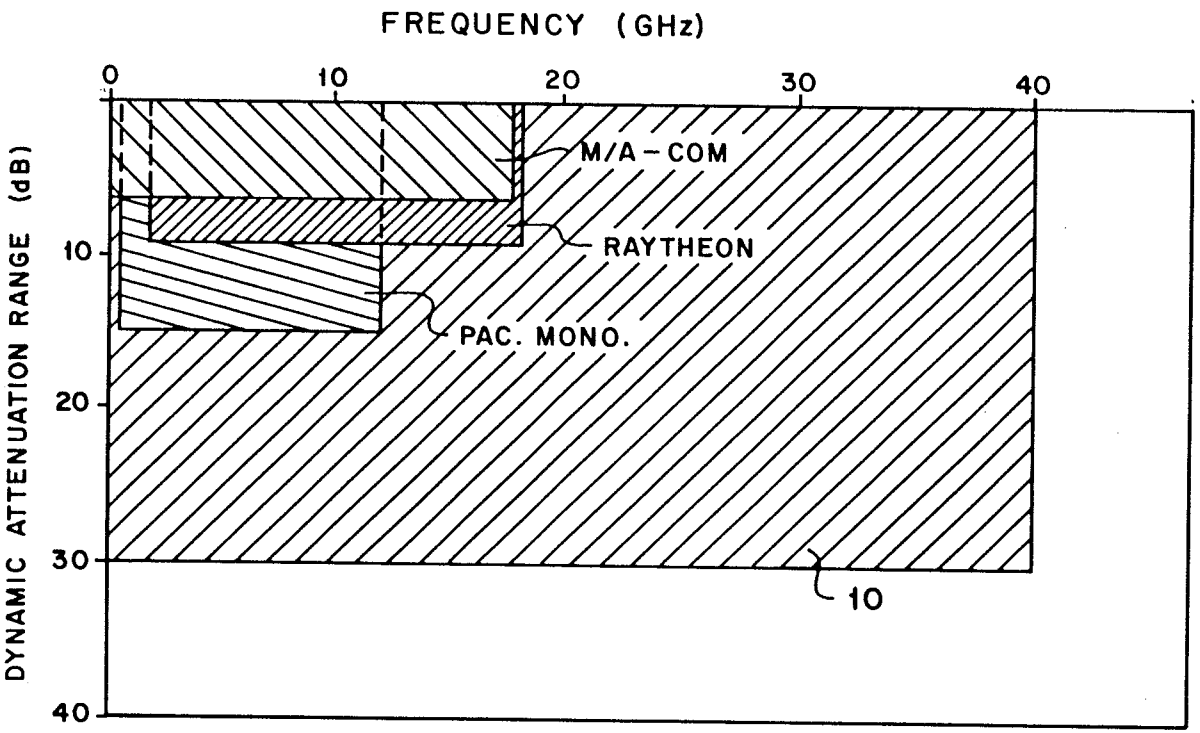
FIG. 8 illustrates a comparison of dynamic range of the attenuator shown in FIG. 3 to commercially available attenuators.

FIG. 8 compares the performance of the attenuator 10 with the performance of known MMIC attenuators reported in the literature. Each rectangle represents an attenuator, indicating its frequency band of operation, minimum insertion loss, and maximum attenuation. The best known performance reported to date is from Raytheon, showing a 3 dB minimum insertion loss and a 12 dB maximum attenuation in a frequency range up to 18 GHz. See the aforementioned Tajima, et al., article. The attenuator 10 in accordance with the invention reveals clear superiority in both attenuation range and higher frequency of operation.

Figure 9:
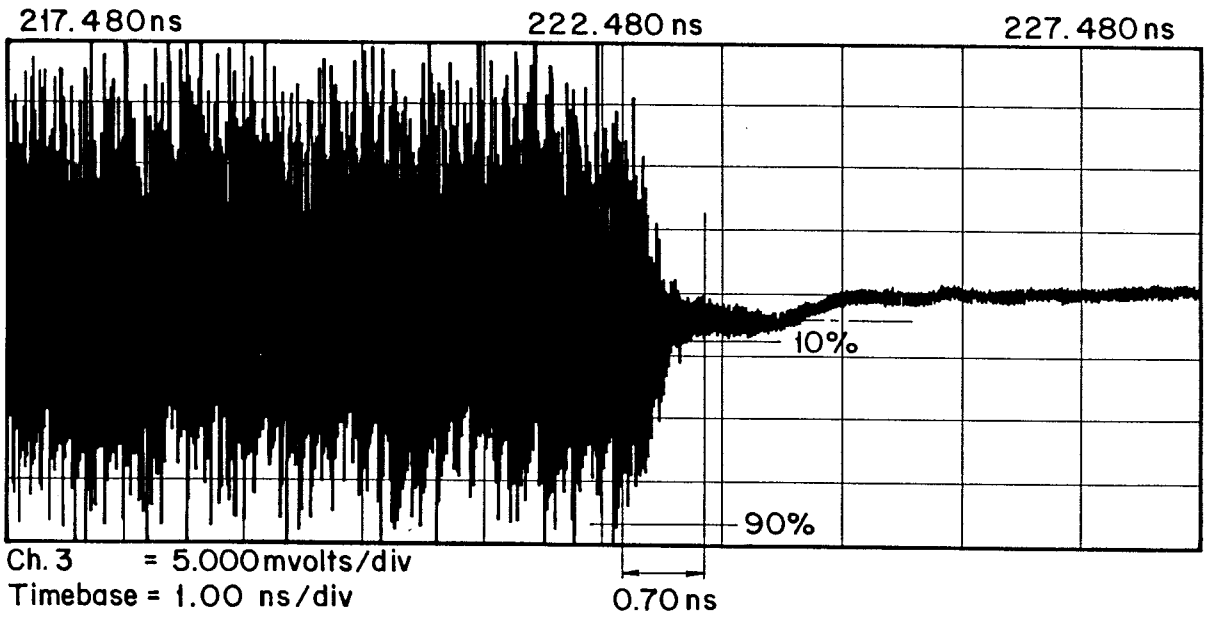
FIG. 9 illustrates the performance of the attenuator shown in FIG. 3 employed as a single-pole-single-throw switch driven by 5 MHz pulses.

The attenuator 10 in accordance with the invention can also be used as a single-pole-single-throw (SPST) switch when driven by two complementary pulses applied to the control voltage terminals. FIG. 9 shows the switching characteristics of the attenuator 10 driven by 5 MHz pulses. The reverse bias on the gates of the series FETs 16 and 28 and distributed shunt FET 24 is −3 to −4 volts in the OFF state, and 0 volts in the ON state.

This provides a high-speed, low-bias-power, wideband switch which exhibits low ON insertion loss at relatively low attenuation settings, while still maintaining adequate OFF isolation at relatively high attenuation settings. The switching time is less than 1.5 ns.

The maximum input power for the attenuator 10 shown in FIG. 3 is 13–18 dBm for −20 dBc second harmonic. In order to increase the power handling capability of the attenuator 10, dual gates can be used for the distributed shunt FET 24. By the use of a dual gate structure, the knee voltage of the IV curve, as well as the breakdown voltage, is increased considerably so as to provide a high power version of the attenuator 10.

An embodiment of the attenuator in accordance with the invention has been described, and various modifications have been presented, by way of example. Other modifications will be obvious to persons skilled in the art that are within the spirit of this invention. In order to appreciate the true scope of this invention, reference must therefore be made to the appended claims.

What is claimed is:

1. A FET variable absorptive attenuator having an input and output and including a plurality of FETs connected between the input and the output and utilized as variable resistors controlled by voltages applied to their gate terminals, comprising:

a first series FET, a shunt FET, and a second series FET connected in a T configuration;

a first voltage supply for providing a first control voltage to adjust the resistances of the first and second series FETs to bias the first and second series FETs well below their pinch-off voltages at relatively high attenuation settings;

a second voltage supply for providing a second control voltage to adjust the resistance of the shunt FET;

a first resistor connected in parallel with the first series FET, the first resistor having a predetermined resistance depending on the output impedance of an external circuit connected to the input of the attenuator; and a second resistor connected in parallel with the second series FET, the second resistor having a predetermined resistance depending on the input impedance of an external circuit connected to the output of the attenuator;

whereby the first and second resistors allow the first and second series FETs to be biased well below their pinch-off voltages to minimize parasitic capacitances at relatively high attenuation settings, as well as improve the isolation for high attenuation settings at relatively high frequencies thereby increasing bandwidth and extending the dynamic range of attenuation.

2. The attenuator according to claim 1, further comprising means for providing a combination of the first and second control voltages to yield a desired level of attenuation with optimum input/output impedance matching.

3. The attenuator according to claim 1 wherein the first and second resistors have a resistance of approximately 50 ohms.

4. The attenuator according to claim 1, further comprising:

a first inductive reactance connected in series with the first resistor, the first resistor and first inductive reactance being connected in parallel with the first series FET; and a second inductive reactance connected in series with the second resistor, the second resistor and second inductive reactance being connected in parallel with the second series FET.

5. The attenuator according to claim 1 wherein the shunt FET is in the form of a distributed shunt FET.

6. The attenuator according to claim 5, wherein the distributed shunt FET is split into a plurality of cells given by $$(Pi)(f_c)\sqrt{\frac{(32)(50)(C_{50})}{\left(\frac{G_{F0}}{C_{F0}}\right)\left(\frac{C_{F0}}{C_{FP}}\right)}} \leqq N << \frac{1}{50\ G_{FP}}$$

where N is the number of shunt FET cells;

$f_c$ is the cutoff frequency;

$C_{50}$ is the capacitance of a series FET for its resistance value of 50 ohms;

$G_{FO}$ is the conductance of a shunt FET cell biased at zero volts at its gate;

$C_{FO}$ is the capacitance of a shunt FET cell biased at zero volts at its gate;

$C_{FP}$ is the capacitance of a shunt FET cell biased below its pinch-off voltage; and $G_{FP}$ is the conductance of a shunt FET cell biased below its pinch-off voltage.

7. The attenuator according to claim 5, wherein dual gates are used for the distributed shunt FET.

8. A FET variable absorptive attenuator having an input and output and including a plurality of FETs connected between the input and the output and utilized as variable resistors controlled by voltages applied to their gate terminals, comprising:

a first series FET, a distributed shunt FET, and a second series FET connected in a T configuration;

the distributed shunt FET being split into a plurality of cells to provide low resistance when the cells of the distributed shunt FET are zero-biased at relatively high attenuation settings;

a plurality of inductive reactances interconnected between adjacent cells of the distributed shunt FET;

the combination of the resistances of the adjacent cells of the distributed shunt FET and the interconnected inductive reactances forming an LR circuit when the cells of the distributed shunt FET are zero-biased at relatively high attenuation settings and relatively high frequencies so that the voltage drop across the equivalent inductive reactance of the LR circuit is relatively greater than the voltage drop across the equivalent resistance of the LR circuit;

a first voltage supply for providing a first control voltage to adjust the resistances of the first and second series FETs; and a second voltage supply for providing a second control voltage to adjust the resistance of the shunt FET;

whereby the distributed shunt FET provides a low insertion loss at maximum attenuation, as well as decreases the parasitic capacitance of the shunt FET which can be more effectively compensated for by the inductive reactances thereby extending the dynamic range of attenuation at relatively high frequencies; and whereby the inductive reactances compensate for the parasitic capacitance of the series FETs at relatively high attenuation settings thereby yielding increased attenuation with increasing frequency and increasing the cutoff frequency of the attenuator at relatively low attenuation settings.

9. The attenuator according to claim 8, wherein the inductive reactances are in the form of transmission lines.

10. The attenuator according to claim 8, wherein the plurality of cells is given by $$(Pi)(f_c)\sqrt{\frac{(32)(50)(C_{50})}{\left(\frac{G_{F0}}{C_{F0}}\right)\left(\frac{C_{F0}}{C_{FP}}\right)}} \leqq N << \frac{1}{50\ G_{FP}}$$

where N is the number of shunt FET cells;

$f_c$ is the cutoff frequency;

$C_{50}$ is the capacitance of a series FET for its resistance value of 50 ohms;

$G_{FO}$ is the conductance of a shunt FET cell biased at zero volts at its gate;

$C_{FO}$ is the capacitance of a shunt FET cell biased at zero volts at its gate;

$C_{FP}$ is the capacitance of a shunt FET cell biased below its pinch-off voltage; and $G_{FP}$ is the conductance of a shunt FET cell biased below its pinch-off voltage.

11. The attenuator according to claim 8, wherein the first voltage supply provides a first control voltage to adjust the resistances of the first and second series FETs to bias the first and second series FETs well below their pinch-off voltages at relatively high attenuation settings, further comprising:

a first resistor connected in parallel with the first series FET, the first resistor having a predetermined resistance depending on the output impedance of an external circuit connected to the input of the attenuator; and a second resistor connected in parallel with the second series FET, the second resistor having a predetermined resistance depending on the input impedance of an external circuit connected to the output of the attenuator;

whereby the first and second resistors allow the first and second series FETs to be biased well below their pinch-off voltages to minimize parasitic capacitances at relatively high attenuation settings, as well as improve the isolation for high attenuation settings at relatively high frequencies thereby increasing bandwidth and extending the dynamic range of attenuation.

12. The attenuator according to claim 11, further comprising:

a first inductive reactance connected in series with the first resistor, the first resistor and first inductive reactance being connected in parallel with the first series FET; and a second inductive reactance connected in series with the second resistor, the second resistor and second inductive reactance being connected in parallel with the second series FET.

13. A FET variable absorptive attenuator having an input and output and including a plurality of FETs connected between the input and the output and utilized as variable resistors controlled by voltages applied to their gate terminals, comprising:

a first series FET, a distributed shunt FET, and a second series FET connected in a T configuration;

the distributed shunt FET being split into a plurality of cells;

a plurality of inductive reactances interconnected between adjacent cells of the distributed shunt FET;

a first voltage supply for providing a first control voltage to adjust the resistances of the first and second series FETs;

a second voltage supply for providing a second control voltage to adjust the resistance of the shunt FET;

the first series FET having its drain connected to the input, its gate connected to the first voltage supply, and its source connected to a first inductive reactance;

the distributed shunt FET being split into n cells, each cell having its drain connected between respective inductive reactances n and n+1, its gate connected to the second voltage supply, and its source connected to common; and the second series FET having its source connected to the inductive reactance n+1, its gate connected to the first voltage supply, and its drain connected to the output;

whereby the distributed shunt FET provides a low insertion loss at maximum attenuation, as well as decreases the parasitic capacitance of the shunt FET which can be more effectively compensated for by the inductive reactances thereby extending the dynamic range of attenuation at relatively high frequencies; and whereby the inductive reactances compensate for the parasitic capacitance of the series FETs at relatively high attenuation settings thereby yielding increased attenuation with increasing frequency and increasing the cutoff frequency of the attenuator at relatively low attenuation settings.

14. The attenuator according to claim 13, wherein the inductive reactances are in the form of transmission lines.

15. The attenuator according to claim 13, wherein dual gates are used for the distributed shunt FET.

16. The attenuator according to claim 13, further comprising:

a first resistor connected between the drain and source of the first series FET; and a second resistor connected between the drain and source of the second series FET.

17. The attenuator according to claim 16, further comprising:

a first inductive reactance connected in series with the first resistor between the drain and source of the first series FET; and a second inductive reactance connected in series with the second resistor between the drain and source of the second series FET.

18. The attenuator according to claim 16 wherein the first resistor has a predetermined value of resistance depending on the output impedance of an external circuit connected to the input and the second resistor has a predetermined value of resistance depending on the input impedance of an external circuit connected to the output.

19. The attenuator according to claim 18, further comprising means for providing a combination of the first and second control voltages to yield a desired level of attenuation with optimum input/output impedance matching.

20. The attenuator according to claim 18, wherein the first and second resistors are approximately 50 ohms.

21. A FET variable absorptive attenuator having an input and output and including a plurality of FETs connected between the input and the output and utilized as variable resistors controlled by voltages applied to their gate terminals to provide a single-pole-single-throw switch, comprising:

a first series FET, a shunt FET, and a second series FET connected in a T configuration;

a pulse source connected to the first and second series FETs and the shunt FET for providing a first voltage level and a second voltage level, the first voltage level being applied to the first and second series FETs to gate the first and second series FETs ON and the second voltage level being applied to the shunt FET to gate the shunt FET OFF, thereby closing the switch, and, alternatively, the second voltage level being applied to the first and second series FETs to bias the first and second series FETs well below their pinch-off voltages to gate the first and second series FETs OFF and the first voltage level being applied to the shunt FET to gate the shunt FET ON, thereby opening the switch;

a first resistor connected in parallel with the first series FET, the first resistor having a predetermined resistance depending on the output impedance of an external circuit connected to the input of the attenuator; and a second resistor connected in parallel with the second series FET, the second resistor having a predetermined resistance depending on the input impedance of an external circuit connected to the output of the attenuator;

whereby the first and second resistors improve the isolation at relatively high frequencies thereby increasing the bandwidth of the switch.

* * * * *

UNITED STATES PATENT AND TRADEMARK OFFICE

CERTIFICATE OF CORRECTION

PATENT NO. : 4,837,530

DATED : June 6, 1989

INVENTOR(S) : Hiroshi Kondoh

It is certified that error appears in the above-identified patent and that said Letters Patent is hereby corrected as shown below:

Column 1, Line 51, "built-up voltage" should read -- built-in voltage --;

Column 8, Line 37, "across the band 32 dB at" should read -- across the band (32 dB at --;

Column 8, Line 46, "attenuation settings exhibited" should read -- attenuation settings, exhibiting --.

Signed and Sealed this

Twentieth Day of March, 1990

*Attest:*

JEFFREY M. SAMUELS

*Attesting Officer*

*Acting Commissioner of Patents and Trademarks*